United States Patent [19]

Patterson et al.

[11] 4,378,609

[45] Apr. 5, 1983

[54] SOFA BED WITH MATTRESS LONGITUDINALLY COMPRESSED FOR STORAGE AND METHOD

[75] Inventors: Charles A. Patterson, Long Beach; Tim M. Uyeda, South San Gabriel, both of Calif.

[73] Assignee: Simmons U.S.A., Atlanta, Ga.

[21] Appl. No.: 254,168

[22] Filed: Apr. 14, 1981

[51] Int. Cl.[3] ..... A47C 17/207

[52] U.S. Cl. ..... 5/12 R; 5/18 R; 5/28; 5/44 R

[58] Field of Search ..... 5/12–14, 5/17, 18, 22, 23

[56] References Cited

U.S. PATENT DOCUMENTS

| | | | |
|---|---|---|---|
| 950,925 | 3/1910 | Karpen | 5/17 |
| 1,691,992 | 11/1928 | Putty | 5/12 R |
| 2,832,083 | 4/1958 | Sevcik | 5/14 |
| 2,962,729 | 12/1960 | Bebry | 5/13 |
| 3,482,270 | 12/1969 | Hill | 5/13 |
| 3,771,178 | 11/1973 | Inman | 5/13 |

FOREIGN PATENT DOCUMENTS

| | | | |
|---|---|---|---|
| 541367 | 7/1948 | Canada | 5/13 |

*Primary Examiner*—Francis K. Zugel
*Assistant Examiner*—Michael F. Trettel
*Attorney, Agent, or Firm*—Bell, Seltzer, Park & Gibson

[57] ABSTRACT

The present sofa bed includes a mattress supporting bed frame which is operable to longitudinally compress a portion of the mattress when the bed frame is moved to a folded and storage seat position. The bed frame or telescoping section which permits longitudinal expansion of the mattress when the bed frame is moved to an unfolded and extended bed position. A simple and lightweight bed frame operating and support linkage operates the telescoping bed section when moved between the stored and extended bed positions. The longitudinal compression of the mattress permits the mattress to be stored in a relatively narrow space and to be expanded to a full length bed dimension when moved to the unfolded and extended bed position.

9 Claims, 8 Drawing Figures

SOFA BED WITH MATTRESS LONGITUDINALLY COMPRESSED FOR STORAGE AND METHOD

FIELD OF THE INVENTION

This invention relates generally to a sofa bed and method of storing a mattress in a compact folded condition, and more particularly to a sofa bed including a mattress supporting bed frame which is operable to longitudinally compress a portion of the mattress when moved to a folded and storage seat position and for permitting longitudinal expansion of the mattress when moved to an unfolded and extended bed position.

BACKGROUND OF THE INVENTION

Many different types of sofa beds have been manufactured with a bed frame for folding a mattress into a storage seat position. The sofa beds presently available usually have complicated operating mechanisms for folding and unfolding the bed sections which increases the cost of manufacture and adds to the weight and bulk of the sofa bed.

In order to provide a mattress of sufficient length to accommodate a person of average height, while maintaining the width of the seat of the sofa bed about the same as the width of a conventional normal sofa seat, many sofa beds are provided with a very thick backrest so that a portion of the bed frame and/or mattress may be stored in substantially a vertical position in the backrest. Examples of various types of sofa beds in which a portion of the bed frame and/or mattress is stored behind the backrest are disclosed in U.S. Pat. Nos. 4,227,268; 4,204,287; 4,086,671; 3,974,529; 3,934,281; and 2,007,988.

The provision of a thick backrest to provide for the storage of a portion of the bed frame and/or mattress adds to the width of the sofa bed. This additional width is objectionable because sofa beds are normally used in areas where floor space is limited. Also, the provision of a thick backrest imposes undesirable limitations on the designer of sofa beds.

SUMMARY OF THE INVENTION

With the foregoing in mind, it is an object of the present invention to provide a sofa bed and method of storing a mattress so that the mattress is stored in a compact folded condition in the seat of the sofa to eliminate the need for a very thick backrest on the sofa. The bed frame of the present sofa includes a very simple and lightweight linkage which operates to longitudinally compress the mattress when in the folded and storage seat position and permits longitudinal expansion of the mattress when moved to an unfolded and extended bed position.

In accordance with the present invention, the bed frame includes a section of fixed length and a telescoping section with a movable portion supported for longitudinal sliding movement into and outwardly of a fixed portion. A simple operating and supporting linkage connects and supports the bed frame on the side frames of the sofa and is operable to move the movable portion into the fixed portion of the telescoping section so that the corresponding portion of the mattress is longitudinally compressed when the bed frame is moved to the folded seat position. The linkage is also operable to move the movable portion outwardly of the fixed portion of the telescoping bed section so that the corresponding portion of the mattress may expand in a longitudinal direction when the bed frame is moved to the unfolded and extended bed position. This longitudinal compression and expansion of the portion of the mattress supported on the telescoping bed section permits the mattress to be stored in a folded condition in a relatively narrow seat of a sofa while providing a relatively long mattress when the mattress is unfolded and extended in the bed position.

The operating and supporting linkage is of very simple construction and is connected between the side frames of the sofa and the telescoping bed section in such a manner as to facilitate the movement of the bed frame between the stored and extended bed positions with very little effort on the part of only one person. The operating and supporting linkage includes only three levers at each side of the bed frame, i.e., a pair of pivotally connected toggle levers and a single operating lever. One end of the operating lever is pivotally supported in the side frame and the other end is pivotally supported on the fixed portion of the telescoping section. Corresponding ends of the toggle levers are pivotally connected to each other and to the rear portion of the movable portion of the telescoping section. One end of one of the toggle levers is pivotally supported intermediate the ends of the operating lever and the other end of the other toggle lever is pivotally supported on the side frame of the sofa.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figures 5, 6:
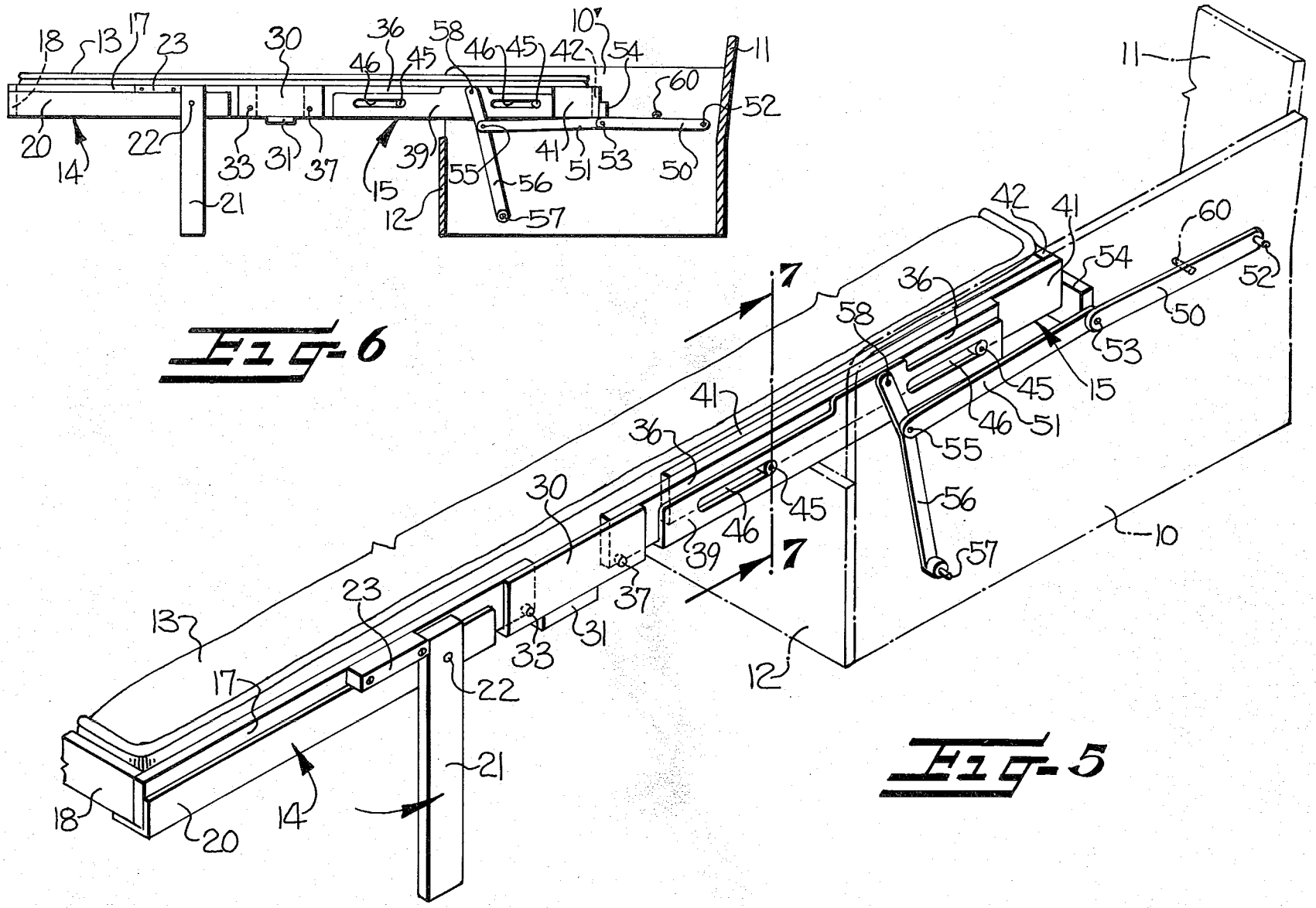
FIG. 5 is a fragmentary isometric view of one side of the sofa bed, illustrating the bed frame and mattress in the unfolded and extended bed position.
FIG. 6 is a view similar to FIG. 2 but showing the bed frame in the unfolded and extended bed position shown in FIG. 5.
Figure 7:
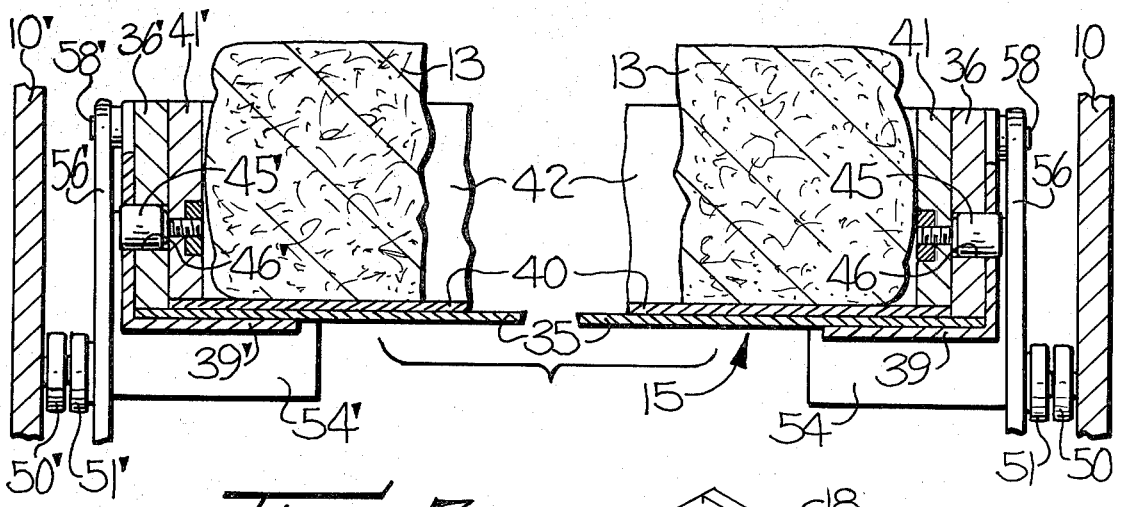
FIG. 7 is an enlarged fragmentary vertical sectional view taken substantially along the line 7—7 in FIG. 5 and showing both sides of the bed frame and mattress.

Referring specifically to the drawings, the convertible sofa bed of the present invention includes the same parts on each side and the parts on the side toward the observer will be described in detail and the corresponding parts on the other side will bear the same reference characters, with the prime notation added. The sofa bed includes a pair of spaced upright side frames 10, 10' and an upstanding backrest 11 suitably connected at opposite ends to and extending between the side frames 10, 10'. A front cross brace 12 is suitably connected at opposite ends to the side frames 10, 10' and maintains the same in spaced relationship. A bed frame supports a mattress 13 for movement between the folded seat position inside of the side frames, 10, 10' (FIGS. 1 and 2) and an unfolded and extended bed position (FIGS. 5 and 6).

The bed frame includes a bed section of fixed length, broadly indicated at 14, and a telescoping bed section, broadly indicated at 15. The fixed length bed section 14 includes a transverse mattress support 16 with opposite side rails 17, 17' and an end rail 18 at the forward end of the fixed length bed section 14. An angle bracket 20 is fixed to the side rail 17 and the transverse mattress support 16. A support leg 21 is pivotally supported adjacent one end as at 22 on the angle bracket 20 and is movable between a folded position, shown in FIGS. 1–3 and 8, and a support position, shown in FIGS. 5 and 6, with the upper portion thereof in engagement with a stop block 23, which is fixed on the angle bracket 17. The side rails 17, 17' and the end rail 18 of the fixed length bed section 14 serve to confine the forward end portion of the mattress 13, for purposes to be presently described.

Figure 1:
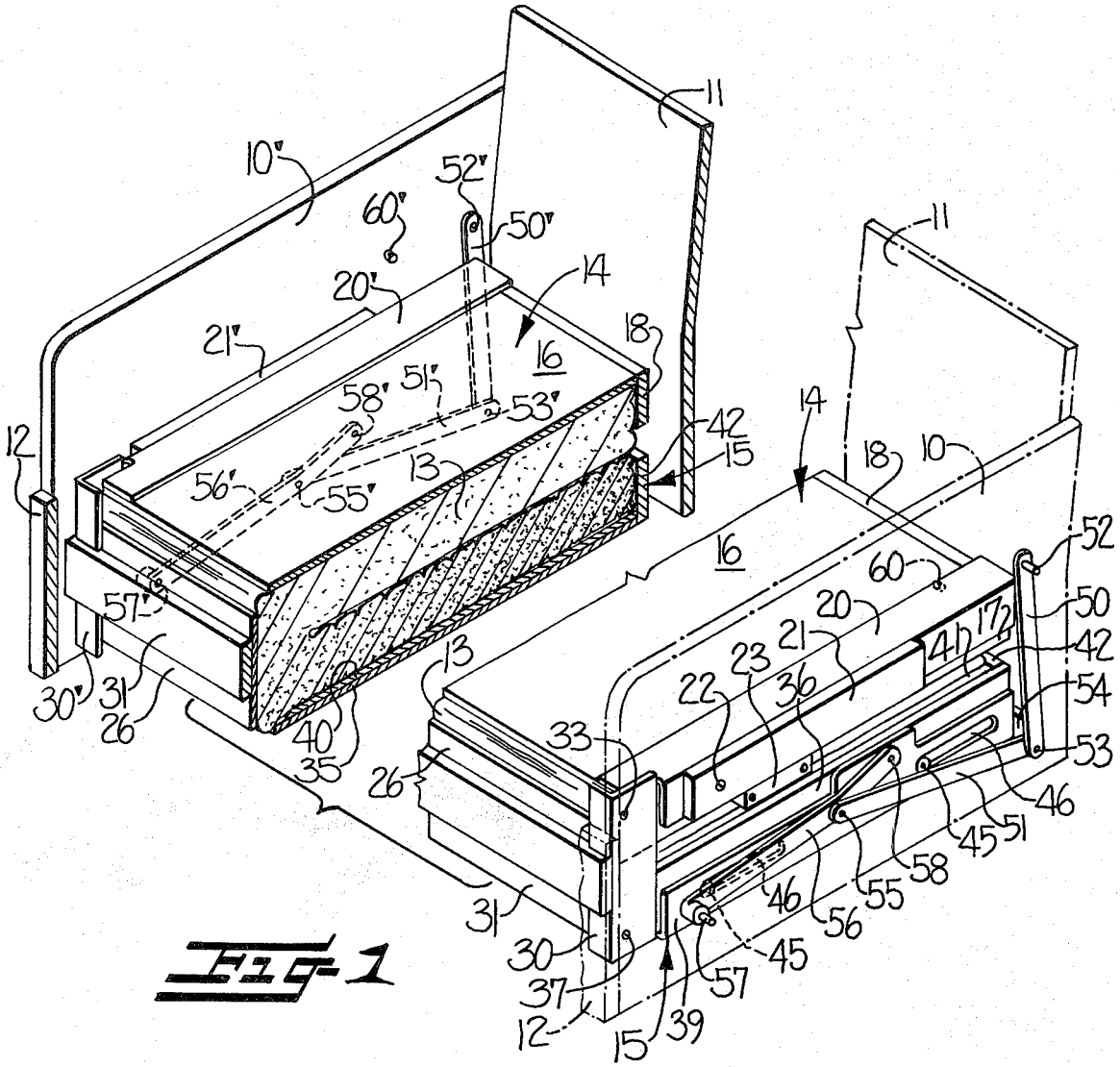
FIG. 1 is a somewhat schematic isometric view of the present sofa bed, with the central portion broken away, and showing one end portion of the sofa bed frame in phantom lines.
Figure 4:
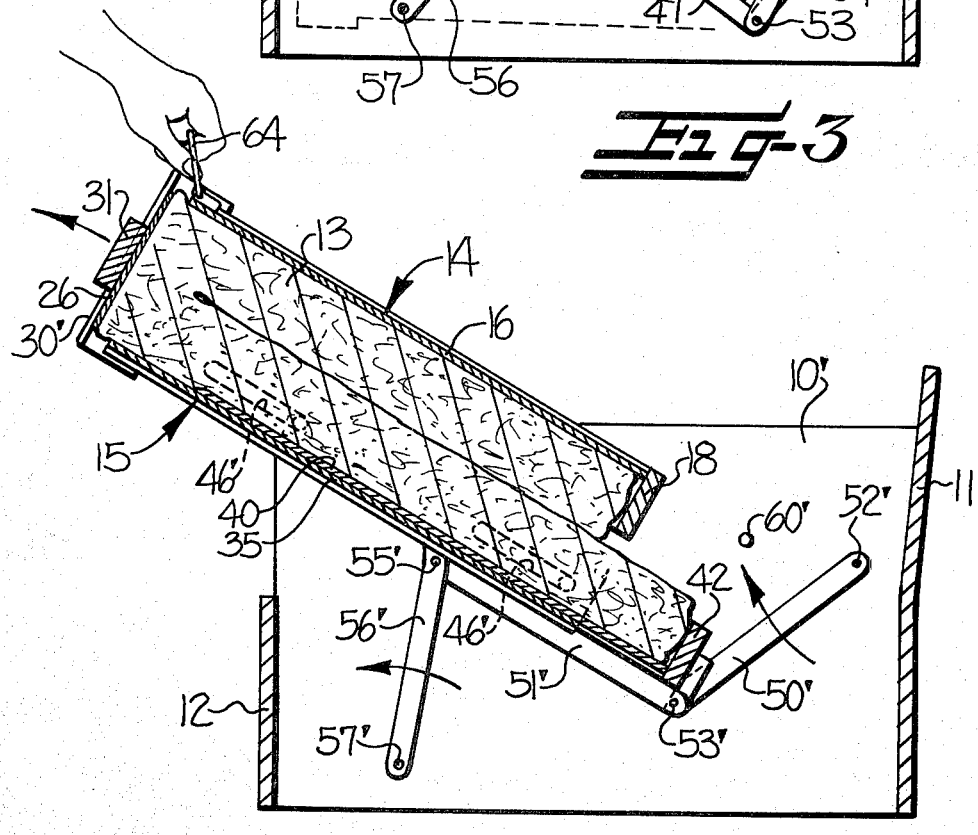
FIG. 4 is a view similar to FIG. 3 but illustrating the mattress and associated bed sections in cross-section and showing further movement of the bed frame toward the extended bed position.

Pivot means is provided for pivotally connecting the rear end of the fixed length bed section 14 to the forward end of the telescoping bed section 15 and includes a short intermediate bed section shown in the form of a mattress support and stop board 26 extending from one side of the mattress 13 to the other and serving as a mattress confining board when the mattress is in the folded condition shown in FIGS. 1 and 4. The stop board 26 also serves to support the medial portion of the mattress 13 when in the unfolded condition, as shown in FIGS. 5 and 6. Pivot brackets 30, 30' are fixed at one flange to the stop board 26 and the other flanges serve as pivot plates interconnecting the fixed length bed section 14 and the telescoping bed section 15. A brace member 31 extends between the pivot brackets 30, 30' and is fixed to the outer face of the stop board 26. One end of the pivot flange of the bracket 30 is pivotally connected to the rear end of the side rail 17 of the fixed length bed section 14 as by a pivot bolt 33.

The telescoping bed section 15 includes a forward fixed portion with a transverse mattress support 35 provided with upstanding side rails 36, 36'. The forward end of the rail 36 is pivotally supported on the pivot flange of the bracket 30, as by a pivot bolt 37. An angle bracket 39 is along one flange to the side rail 36 and along the other flange to the mattress support 35.

The bed section 15 also includes a mattress supporting movable rearward portion supported for longitudinal sliding movement on the fixed portion and including a transverse mattress support 40. Upstanding side rails 41, 41' are fixed at opposite sides of the transverse mattress support 40 and are supported inside of the corresponding side rails 36, 36' of the fixed portion. An upstanding rear end rail 42 is connected at its lower edge to the mattress support 40 and at its opposite ends to the corresponding side rails 41, 41'. The side rails 41, 41' and the rear rail 42 serve to confine the rear portion of the mattress 13, for purposes to be presently described.

Suitable guide rollers 45 are supported on and extend outwardly from the side rail 41 and are supported for longitudinal movement in corresponding guide slots 46 which are formed in the side rail 36 and the angle bracket 39. Thus, the movable portion of the telescoping bed section 15 is supported for longitudinal sliding movement in the fixed portion and operates to longitudinally compress and permit longitudinal expansion of the corresponding rear portion of the mattress 13, in a manner to be presently described.

Very simple and lightweight bed frame operating and support linkage means interconnects opposite sides of the telescoping bed section 15 to the corresponding side frames 10, 10' and includes a pair of pivotally connected toggle levers 50, 51. One end of the toggle lever 50 is pivotally supported, as at 52 on the side frame 10. The other end of the toggle lever 50 is pivotally supported, as at 53 to one end of the toggle lever 51 and also to one end of an operator plate 54 which is also connected along the medial portion to the rear rail 42 of the movable portion of the telescoping bed section 15.

The other end of the toggle lever 51 is pivotally connected, as at 55, to a medial portion of an operating lever 56. One end of the operating lever 56 is pivotally supported, as at 57 on the side frame 10 and the other end of the operating lever 56 is pivotally supported, as at 58 on the angle bracket 39 of the fixed portion of the telescoping bed section 15. A suitable stop pin 60 is fixed in the side frame 10 and is adapted to engage the upper medial portion of the toggle lever 50 when the bed frame is moved to the unfolded and extended bed position shown in FIGS. 5 and 6. Thus, the bed frame operating and support linkage means includes only three levers at each side of the bed frame, the toggle levers 50, 51 and the operating lever 55.

Conventional type seat cushions 62 (FIG. 2) are provided to be positioned and supported on the upper surface of the fixed length bed section 14. Conventional type back cushions 63 (FIG. 2) are provided along the backrest 11. The seat cushions 62 and back cushions 63 are removed when the bed frame is to be moved to the unfolded and extended bed position. A hinged handle 64 (FIG. 4) is provided in the medial upper portion of the rear of the fixed length section 14 to facilitate raising and lowering of the bed frame.

METHOD OF OPERATION

Figure 2:
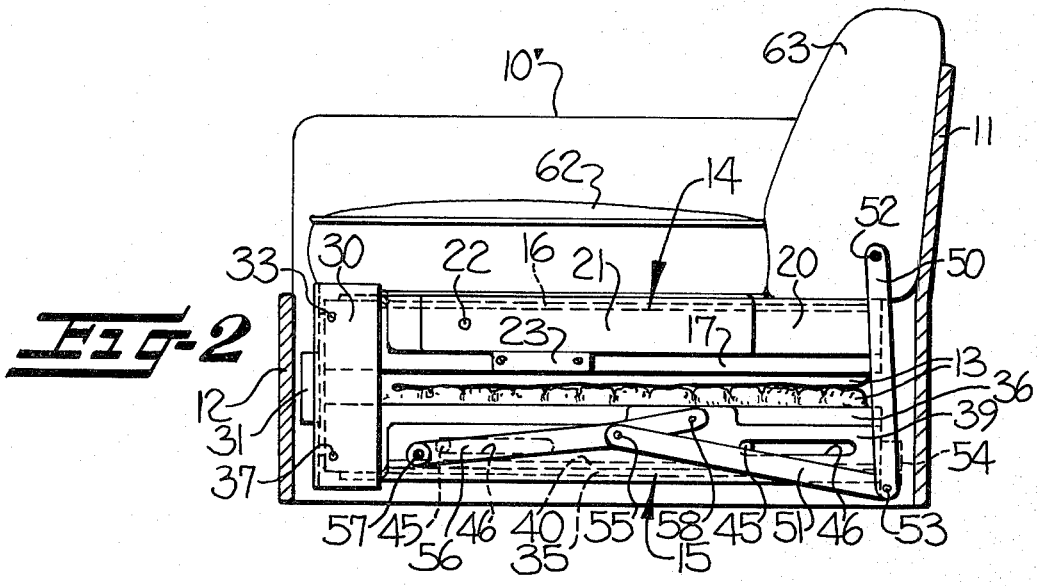
FIG. 2 is a vertical sectional view taken just inside of the side frame shown in phantom lines in FIG. 1 and illustrating one arrangement of seat and back cushions which may be employed with the bed frame and mattress in the folded and stored seat position.
Figure 3:
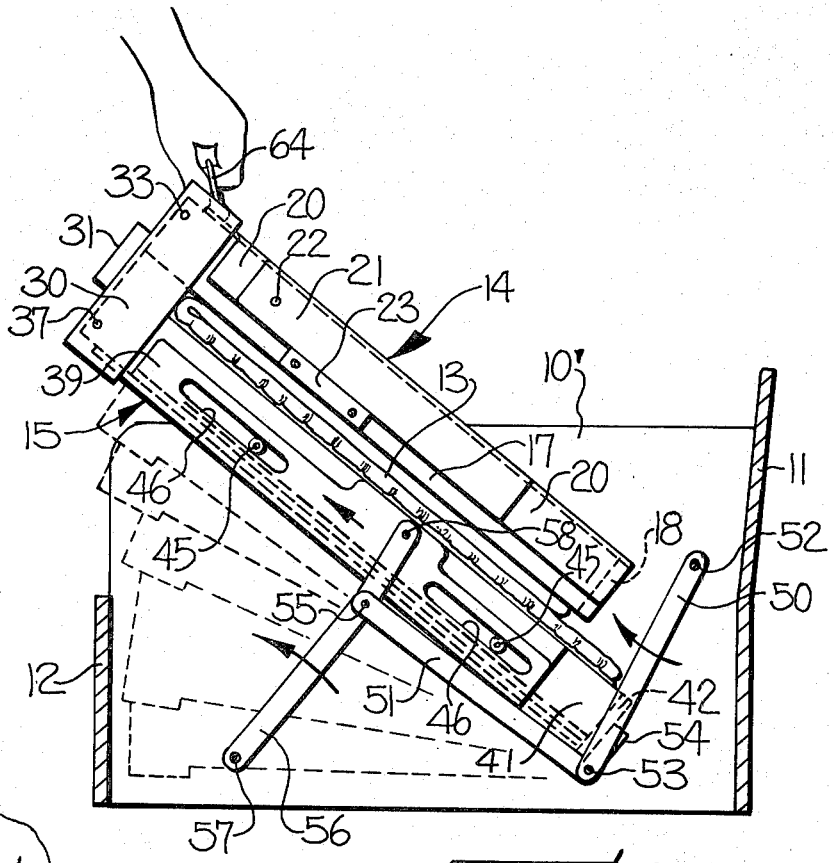
FIG. 3 is a view similar to FIG. 2 but illustrating the bed frame at the beginning of its upwardly and forward movement in the process of being moved from the folded seat position and to the unfolded and extended bed position.

In order to move the bed frame from the folded seat position illustrated in FIGS. 1 and 2, the seat and back cushions 62, 63 are removed and the handle 64 is then grasped and moved upwardly and forwardly (FIGS. 3 and 4). As the bed frame is lifted, the operating lever 56 swings in a counterclockwise direction about the pivot point 57 and the angle between the toggle levers 50, 51 increases. During the first portion of the upwardly and forward movement of the bed frame, as illustrated in FIG. 3, the forward end of the folded bed frame raises upwardly and moves forwardly over the front cross brace 12. At the point at which the toggle levers 50, 51 are positioned at substantially a 90 degree angle relative to each other (FIG. 3), the movable portion of the telescoping bed section 15 is partially drawn out of the fixed portion so that the half of the mattress 13 supported in the telescoping bed section 15 begins to expand in a longitudinal direction.

With further forward movement of the bed frame, as illustrated in FIG. 4, the movable portion of the telescoping bed section 15 is withdrawn further, as the fixed portion is moved forwardly by the operating lever 56, to permit further expansion of the portion of the mattress supported on the telescoping bed section 15. When the telescoping bed section 15 reaches a horizontal position (FIGS. 5 and 6), the mattress 13 is longitudinally expanded to the maximum amount and the fixed length bed section 14 is folded on top of the telescoping bed section 15. The legs 21, 21' are then manually raised to a vertical position against the stop 23 and the fixed length bed section 14 is pivoted 180 degrees to its outermost position, as shown in FIGS. 5 and 6, with the lower ends of the legs 21, 21' resting on the floor.

During this pivotal movement of the fixed length bed section 14, the intermediate short supporting section, defined by the support and stop board 26, is moved to a horizontal position and serves to support the medial portion of the longitudinally expanded mattress 13. When the telescoping bed section 15 is moved to the extended position, it is preferred that the pivotal connection 53 between the toggle levers 50, 51 be positioned slightly above the pivotal connections 52, 55 and that the upper edge portion of the toggle lever 50 engage the stop pin 60 to lock the operating and supporting linkage in position.

To move the bed frame back to the folded seat position, the fixed length bed section 14 is first pivoted over onto the telescoping bed section 15 so that the mattress 13 is folded in off center relationship with the end of the lower portion extending rearwardly beyond the end of the upper portion. The legs 21, 21' are then folded down into parallel relationship with the angle brackets 20, 20' and the handle 64 is lifted and moved rearwardly, as shown in FIGS. 3 and 4. As the bed frame is moved downwardly and rearwardly, the movable portion of the telescoping bed section 15 moves inwardly, relative to the fixed portion, as shown in FIGS. 3 and 4, and the portion of the mattress 13 supported on the telescoping bed section 15 is longitudinally compressed as the end rail 42 moves inwardly and the mattress support and stop board 26 maintains the folded forward end of the mattress in a fixed position. Thus, the end of the lower portion of the folded mattress is moved closer and then into alignment with the end of the upper portion of the mattress to thereby provide a more compact mattress when in the stored position.

Figure 8:
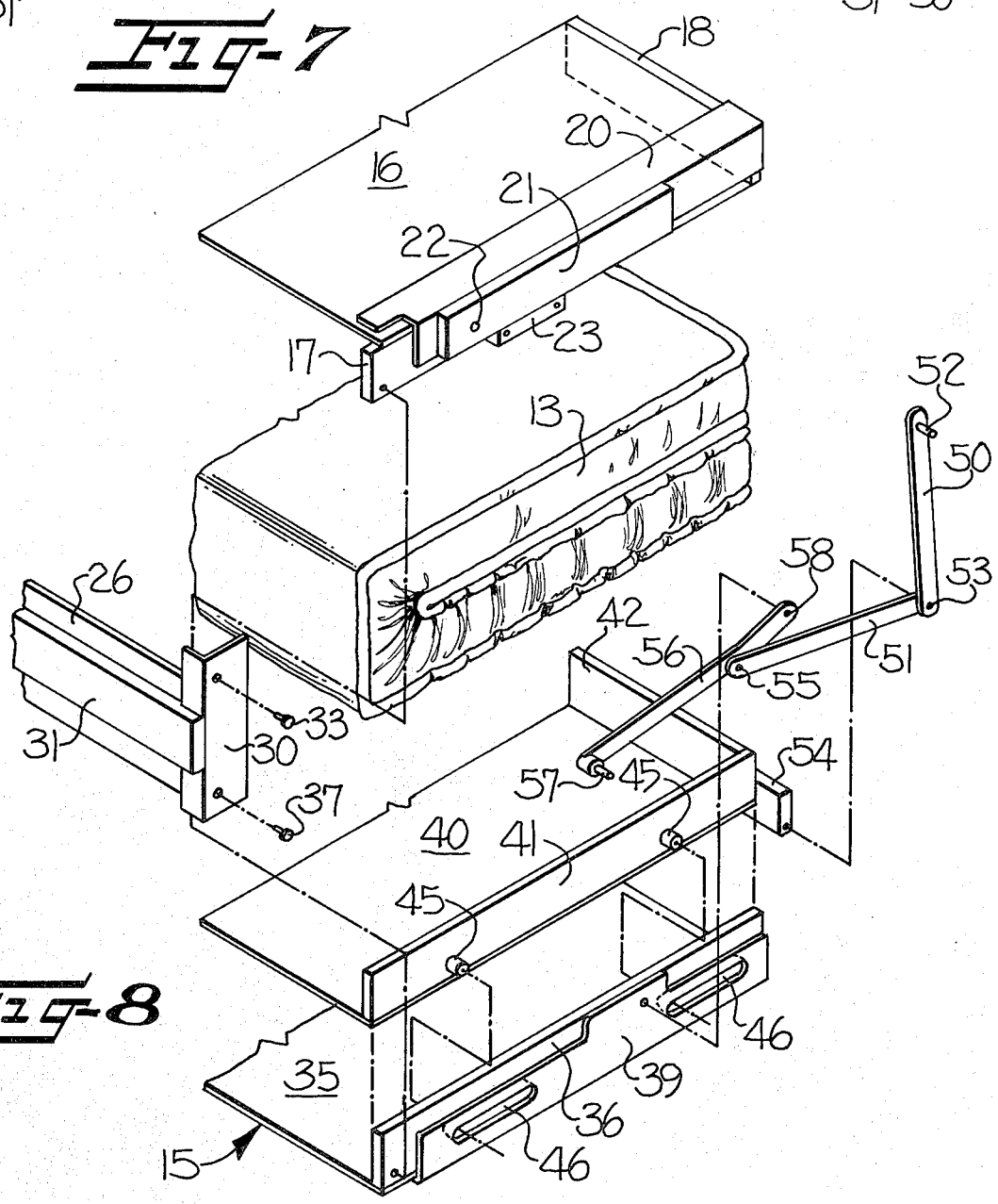
FIG. 8 is an exploded fragmentary isometric view illustrating the manner in which the mattress is folded and the rear portion is longitudinally compressed when the bed frame is in the folded seat position.

The longitudinally compressed lower portion of the folded mattress 13 is best illustrated in FIGS. 1 and 8. When the bed frame is in the fully folded seat position (FIGS. 1 and 2), the operating lever 56 is in a substantially horizontal position and the angle between the toggle levers 50, 51 is less than 90 degrees. After the bed frame has been moved to the folded seat position, the seat and back cushions 62, 63 are replaced and the sofa bed is then fully converted for use as a sofa.

Thus, the bed frame of the sofa bed of the present invention may be easily converted between the folded and stored seat position and the unfolded and extended bed position by a single person with very little effort. Also, the operating and supporting linkage is of simple and lightweight construction and the telescoping bed section longitudinally compresses a portion of the mattress so that the mattress and the bed frame may be stored in a compact condition in the seat of the sofa and it is not necessary that a portion of the mattress and/or the bed frame be stored within a portion of the backrest. The telescoping bed section also permits a portion of the mattress to longitudinally expand when the bed frame is moved to the unfolded and expanded bed position.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A convertible sofa bed including a bed frame movable from a folded seat position to an unfolded extended bed position, and a mattress carried by said bed frame and movable therewith from the folded seat position to the unfolded extended bed position, said mattress, when in folded position, being folded off center whereby one portion of the mattress is longer than and projects longitudinally beyond the other portion, and means associated with said bed frame for longitudinally compressing the longer portion of the mattress when the bed frame and mattress are moved in folded condition to the folded seat position whereby the mattress is stored in a more compact condition.

2. A convertible sofa bed according to claim 1 wherein said sofa bed includes side frames and wherein said means for compressing the longer portion of the mattress includes a telescoping bed section supporting one portion of the folded mattress, and operating linkage interconnecting said telescoping bed section to said side frames for longitudinally compressing said one portion of said mattress when said bed frame is moved to the folded seat position and for permitting said one portion of said mattress to longitudinally expand when said bed frame is moved to the unfolded extended bed position.

3. A convertible sofa bed including a pair of spaced upright side frames and an upstanding back extending between said side frames, a bed frame supporting a mattress for movement between a folded seat position inside of said side frames and an unfolded and extended bed position, said bed frame comprising a bed section of fixed length including forward and rear ends, a telescoping bed section including forward and rear ends, rail means extending along said rear end of said telescoping bed section and along said forward end of said fixed length bed section to longitudinally confine corresponding ends of said mattress therebetween, said telescoping bed section comprising a forward fixed portion and a rearward movable portion supported for longitudinal sliding movement into and outwardly of said fixed portion, pivot means connecting said rear end of said fixed length bed section to the forward end of said fixed portion of said telescoping bed section, and operating and supporting linkage means interconnecting opposite sides of said bed frame to said side frames and being operable to move said movable portion into said fixed portion of said telescoping bed section and to longitudinally compress the portion of the mattress supported on said telescoping bed section when said bed frame is moved to said folded seat position, said linkage means being operable to move said movable portion outwardly of said fixed portion of said telescoping bed section to permit the portion of the mattress supported on said telescoping bed section to longitudinally expand when said bed frame is moved to said unfolded and extended bed position.

4. A convertible sofa bed according to claim 3 wherein said operating and supporting linkage means is connected to said side frames and to opposite sides of said telescoping bed section.

5. A convertible sofa bed according to claim 3 wherein said pivot means includes a short intermediate bed section including forward and rear ends, the forward end of said intermediate bed section being pivotally connected to the rear end of said fixed length bed section, and the rear end of said intermediate bed section being pivotally connected to the forward end of said fixed portion of said telescoping bed section.

6. A convertible sofa bed according to claim 3 wherein said operating and supporting linkage means comprises a pair of toggle levers including corresponding ends pivotally interconnected to each other and to the rear portion of the movable portion of said telescoping bed section, an operating lever pivotally supported at one end on the side frame and at the other end on the fixed portion of said telescoping bed section, one end of one of said toggle levers being pivotally supported on said side frame, and the other end of the other of said toggle levers being pivotally supported intermediate the ends of said operating lever whereby angular movement between said toggle levers and swinging movement of said operating lever imparts inward movement to said movable portion of said telescoping bed section when said bed frame is moved to said folded seat position, and imparts outward movement to said movable portion of said telescoping seat section when said bed frame is moved to said unfolded and expanded bed position.

7. A convertible sofa bed according to claim 3 including a pair of foldable legs supported at each side of said fixed length bed section and being movable to a position in alignment with said fixed length bed section when said bed frame is moved to said folded seat position, and said legs being movable to the perpendicular position for supporting said fixed length bed section when said bed frame is moved to said unfolded and expanded bed position.

8. A method of storing a mattress of a sofa bed in a more compact folded manner comprising transversely folding the mattress so as to provide one mattress portion longer than and projecting longitudinally beyond the other mattress portion and then, while moving the folded mattress to stored position where the sofa bed would be utilized as a seat longitudinally, compressing the longer portion of the folded mattress to move the end thereof closer to the end of the shorter portion of the mattress to thereby provide a more compact mattress when in stored position.

9. A method according to claim 8 wherein the end of the longer portion of the folded mattress is moved into alignment with the end of the shorter portion of the mattress when the longer portion is compressed.

* * * * *